US009499887B2

(12) United States Patent
Inoue et al.

(10) Patent No.: US 9,499,887 B2
(45) **Date of Patent: *Nov. 22, 2016**

(54) MAGNESIUM ALLOY SHEET

(71) Applicant: SUMITOMO ELECTRIC INDUSTRIES, LTD., Osaka-shi, Osaka (JP)

(72) Inventors: Ryuichi Inoue, Osaka (JP); Nozomu Kawabe, Osaka (JP); Nobuyuki Mori, Osaka (JP); Masatada Numano, Osaka (JP); Junichi Matsumoto, Osaka (JP); Motonori Nakamura, Osaka (JP); Masayuki Nishizawa, Osaka (JP); Atsushi Kimura, Osaka (JP); Yukihiro Oishi, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 318 days.

This patent is subject to a terminal disclaimer.

(21) Appl. No.: 14/451,117

(22) Filed: Aug. 4, 2014

(65) Prior Publication Data

US 2015/0017057 A1 Jan. 15, 2015

Related U.S. Application Data

(63) Continuation of application No. 14/664,816, filed as application No. PCT/JP2008/001466 on Jun. 9, 2008, now Pat. No. 8,828,158.

(30) Foreign Application Priority Data

Jun. 28, 2007 (JP) ..... 2007-171071

(51) Int. Cl.

| | |
|---|---|
| ***C22C 1/02*** | (2006.01) |
| ***C22C 23/04*** | (2006.01) |
| ***C22C 23/02*** | (2006.01) |
| ***C22F 1/06*** | (2006.01) |
| ***C22C 23/00*** | (2006.01) |

(52) U.S. Cl.

CPC ..... *C22C 23/04* (2013.01); *C22C 23/00* (2013.01); *C22C 23/02* (2013.01); *C22F 1/06* (2013.01)

(58) Field of Classification Search

CPC ..... C22C 23/00; C22C 23/02; C22C 23/04; C22F 1/06

USPC ..... 148/557

See application file for complete search history.

(56) References Cited

U.S. PATENT DOCUMENTS

| | | | |
|---|---|---|---|
| 2,104,249 | A | 1/1938 | Vass |
| 3,660,207 | A | 5/1972 | Schrade et al. |

(Continued)

FOREIGN PATENT DOCUMENTS

| | | | |
|---|---|---|---|
| AU | 2006229212 | B2 | 10/2006 |
| CN | 1513063 | A | 7/2004 |

(Continued)

OTHER PUBLICATIONS

Relationship between crystalline structure and X-ray data: peak positions, intensity and widths, published online in address: www.doitpoms.ac.uk/tlplib/xray-diffraction/peak.php, 2page, online Jun. 2010.

(Continued)

*Primary Examiner* — Jie Yang

(74) *Attorney, Agent, or Firm* — McDermott Will & Emery LLP

(57) ABSTRACT

The invention offers a magnesium alloy sheet having excellent warm plastic formability, a production method thereof, and a formed body produced by performing warm plastic forming on this sheet. The magnesium alloy sheet is produced by giving a predetermined strain to a rolled sheet RS that is not subjected to a heat treatment aiming at recrystallization. The sheet is not subjected to the foregoing heat treatment even after the giving of a strain. The strain is given through the process described below. A rolled sheet RS is heated in a heating furnace 10. The heated rolled sheet RS is passed between rollers 21 to give bending to the rolled sheet RS. The giving of a strain is performed such that the strain-given sheet has a half peak width of 0.20 deg or more and 0.59 deg or less in a (0004) diffraction peak in monochromatic X-ray diffraction. The alloy sheet exhibits high plastic deformability by forming continuous recrystallization during warm plastic forming through the use of the remaining strain.

16 Claims, 2 Drawing Sheets

(56) References Cited

U.S. PATENT DOCUMENTS

| | | | | |
|---|---|---|---|---|
| 7,726,383 | B2 | 6/2010 | Pircher et al. | |
| 8,828,158 | B2 * | 9/2014 | Inoue | C22C 23/02 148/557 |
| 2006/0283529 | A1 | 12/2006 | Ghosh et al. | |
| 2009/0035171 | A1 | 2/2009 | Kawamura et al. | |

FOREIGN PATENT DOCUMENTS

| | | | |
|---|---|---|---|
| CN | 1969054 | A | 5/2007 |
| JP | 2005-281848 | A | 10/2005 |
| JP | 2005-298885 | A | 10/2005 |
| JP | 2006-144059 | A | 6/2006 |
| JP | 2007-098470 | A | 4/2007 |
| JP | 2004-351486 | A | 12/2014 |
| RU | 2252088 | | 12/2004 |
| TW | 527239 | B | 4/2003 |
| TW | 200401038 | A | 1/2004 |
| TW | 200528584 | A | 9/2005 |
| TW | 200636081 | A | 10/2006 |
| WO | 01/30519 | A1 | 5/2001 |
| WO | 2006/104028 | A1 | 10/2006 |

OTHER PUBLICATIONS

Drawin et al., Micro-structural properties of Nb—Si alloys investigated using EBSD at large and small scale, Metallurgical and materials transations A, vol. 36A, (Mar. 2005), pp. 497-505.

Miyahara et al., Grain refinement and superplasticity in a magnesium alloy processes by equal-channel angular pressing, Metallurgical and materials transactions A, vol. 36A, (Jul. 2006) pp. 1705-1711.

Japanese "Examiner's Decision of Refusal," w/partial English translation thereof, issued in Japanese Patent Application No. JP 2009-520297 dated Jun. 28, 2011.

Australian Notice of Acceptance issued in Australian Patent Application No. AU 2008268813 dated Jul. 21, 2011.

Russian Decision to Grant, and English translation thereof, issued in Russian Patent Application No. 2010102774 dated Mar. 15, 2012.

Magnesium processing technology, the first impression of the first edition, edited by the Japan Society for Technology of Plasticity, published by Corona Publishing Co., Ltd., Dec. 15, 2004, pp. 66-71, with partial translation of p. 68, line 9 to p. 69, line 1.

United States Office Action issued in U.S. Appl. No. 13/020,375 dated Aug. 30, 2012.

United States Office Action issued in U.S. Appl. No. 13/020,375 dated May 7, 2013.

Notification of the Office Action dated Jul. 24, 2013, from the Taiwan Patent Office for the corresponding Taiwanese Patent Application No. 097123899.

Chinese Office Action, with English translation thereof, issued in Chinese Patent Application No. CN 201110049813 dated Aug. 24, 2012.

* cited by examiner (I) Sample No. 4

(II) Sample No. 101

(III) Sample No. 4 (after tensile test at 275℃)

MAGNESIUM ALLOY SHEET

RELATED APPLICATIONS

This application is a Continuation of application Ser. No. 12/664,816 filed on Dec. 15, 2009, now U.S. Pat. No. 8,828,158, which is the U.S. National Phase under 35 U.S.C. §371 of International Application No. PCT/JP2008/001466, filed on Jun. 9, 2008, which in turn claims the benefit of Japanese Application No. 2007-171071, filed on Jun. 28, 2007, the entire disclosures of which applications are incorporated by reference herein.

TECHNICAL FIELD

The present invention relates to a magnesium alloy sheet, a formed body produced by performing plastic forming on this sheet, and a production method of the sheet. In particular, the present invention relates to a magnesium alloy sheet having high formability in warm plastic forming (the temperature of the work piece at the time of forming: 200° C. to 300° C.).

BACKGROUND ART

Engineers have been using magnesium alloys produced by adding various elements to magnesium for components such as packages of mobile devices including cellular phones and notebook personal computers and parts of automobiles. However, magnesium alloy, which has a hexagonal crystalline structure (a hexagonal close-packed structure), has poor plastic formability at ordinary temperature. Consequently, the magnesium alloy product used for the above-described packages and the like is mainly produced by using a cast material formed by the die casting process or thixomold process.

On the other hand, a malleable magnesium alloy such as AZ31, which is relatively easy to perform plastic forming, has been subjected to plastic forming such as press forming or forging. For example, engineers have been developing a press-formed body that is formed by performing press forming on a rolled sheet which is formed by rolling an ingot at a temperature range of 200° C. or more (under a wane condition or a hot condition), in the temperature range of which the prismatic plane and pyramidal plane of the hexagonal crystal develop slip deformation. To improve the plastic formability, engineers have studied the texture control of the magnesium alloy into a fine recrystallized texture by, for example, annealing the rolled sheet before the plastic forming (see Patent Literature 1). In addition, Patent Literature 2 has disclosed a technique of inclining the (0002) plane toward the rolled surface by subjecting the rolled sheet to a plurality of times of the treatment that combines a roller lever treatment and a recrystallization heat treatment. Patent Literature 2 intends to improve the plastic formability at 100° C. or below through this technique.

Patent Literature 1: the published Japanese patent application Tokukai 2007-98470

Patent Literature 2: the published Japanese patent application Tokukai 2005-298885

SUMMARY OF INVENTION

Technical Problem

Despite the above description, even when a sheet having a recrystallized texture is obtained by performing a heat treatment aiming at recrystallization, the sheet exhibits work hardening because of the accumulation of the strain in the sheet and the increase in dislocation density during the plastic forming under a warm condition at 200° C. or more, particularly 200° C. or more and 300° C. or less. As a result, the sheet cannot deform with a large amount of elongation, so that the sheet sometimes suffers fracture. Therefore, the sheet having the recrystallized texture produced by the foregoing heat treatment may fail to be processed by the plastic forming to obtain a desired shape.

In addition, the formed body obtained by performing the press forming on a sheet having a texture in which the (0002) plane inclines toward the rolled surface, i.e., the c-axis is not parallel to the direction of the thickness of the sheet but crosses it, tends to produce a large dimple resulting from an impact such as the falling of an object. The texture of the above-described sheet (the texture in which the c-axis crosses the direction of the thickness) is maintained even after the press forming. Consequently, the formed body is in a state in which the (0002) plane crosses the direction of the thickness of the sheet. The sliding plane of the magnesium alloy at ordinary temperature is practically the (0002) plane only. Consequently, even when the foregoing formed body is used at ordinary temperature, if an impact is applied to it resulting from, for example, the falling of an object, the sliding of the (0002) plane easily causes plastic deformation in the direction of the thickness of the sheet, forming a large dimple.

The present invention is made in view of the above circumstances. An object of the present invention is to offer a magnesium alloy sheet having excellent warm plastic formability and a production method thereof.

Another object of the present invention is to offer a magnesium alloy formed body having excellent impact resistance.

Solution to Problem

The present inventors have found that the warm plastic formability of a magnesium alloy sheet (a rolled sheet) can be enhanced by intentionally giving a specific amount of strain to the sheet before the plastic forming, rather than by promoting the recrystallization through performing a heat treatment aiming at recrystallization on the sheet before the plastic forming. When a specific amount of strain is given to the magnesium alloy sheet before the warm plastic forming, the strain energy produced by the foregoing specific amount of strain given in advance is added to the thermal energy given by the heating at the time of the warm plastic forming and the strain energy produced by the strain that is accumulated during the plastic forming. The three types of energy become a driving force to develop continuous recrystallization in the above-described sheet during the warm plastic forming at a temperature range of 200° C. or more. Consequently, the present inventors consider that the foregoing sheet to which a strain is given in advance does not increase the dislocation density, has less tendency to develop work hardening even without particular control of the condition for the plastic forming such as press forming, and can achieve high plastic deformability in that the elongation is increased to 100% or more at a temperature range of 200° C. or more. Based on these findings, the present inventors propose a magnesium alloy sheet of the present invention that has excellent warm plastic deformability.

A magnesium alloy sheet of the present invention has a feature in that it is composed of magnesium-based alloy and it has a half peak width of 0.20 deg or more and 0.59 deg or less in a (0004) diffraction peak in monochromatic X-ray diffraction. The magnesium alloy sheet of the present invention can be produced through the production method of the present invention described below.

A method of the present invention for producing a magnesium alloy sheet is a method of producing a sheet composed of magnesium-based alloy. The method is provided with a step of rolling a material composed of the foregoing magnesium-based alloy and a step of giving a strain to the rolled sheet produced through the rolling operation, with the rolled sheet being under a heated condition. The giving of a strain is performed such that the half peak width in the (0004) diffraction peak becomes 0.20 deg or more and 0.59 deg or less in a monochromatic X-ray diffraction conducted on the sheet after the strain is given. A heat treatment aiming at recrystallization is not performed before and after the step of giving a strain. The present invention is explained below in more detail.

Magnesium Alloy Sheet

Half Peak Width

A magnesium alloy sheet of the present invention is produced by giving a strain intentionally to a rolled sheet. Consequently, the sheet has a crystallite size distribution different from that of a rolled sheet subjected to a heat treatment aiming at recrystallization. The half peak width in X-ray diffraction reflects the distribution of the crystallite size. Consequently, as the indicator of the crystallite size, the magnesium alloy sheet of the present invention uses the half peak width in a specific diffraction line (the (0004) diffraction peak) in monochromatic X-ray diffraction. In the above description, the term "half peak width" is used to mean the width of the peak at 50% of the (0004) diffraction peak intensity. When the half peak width in the (0004) diffraction peak is outside the range of 0.20 deg or more and 0.59 deg or less, the elongation of the sheet cannot be increased to 100% or more under a warm condition (in a temperature range of 200° C. to 300° C.). As a result, a sufficient plastic deformation cannot be performed on various shapes. It is more desirable that the half peak width be 0.30 deg or more and 0.54 deg or less Internal Texture A magnesium alloy sheet of the present invention has a remaining strain (a shear band). Consequently, when the inner portion of the sheet is observed under a microscope, a clear crystal grain boundary is less likely to be observed. In other words, the sheet has a texture in which the crystal grain is unclear. As a result, for the magnesium alloy sheet of the present invention, it is practically impossible or difficult to measure the crystal grain size and the orientation of the individual crystal grains. Nevertheless, because the magnesium alloy sheet of the present invention allows to determine the monochromatic X-ray diffraction peak, it does not appear that the sheet is amorphous. The texture of such a crystal structure is quantitatively shown by using the confidence index (CI) in the electron back scattering diffraction (EBSD) measurement.

Existence of Low-CI Region

The term "CI" is an index showing the sureness in the determination of the crystal orientation described in the instruction manual of the orientation imaging microscopy (OIM) made by TSL Solutions K.K. The CI value can be measured for individual measuring points. It is construed that the orientation is correctly measured for 95% or more of the measuring points at which the CI value is 0.1 or more. A magnesium alloy sheet having undergone the heat treatment aiming at recrystallization is practically constituted by regions having a CI value of 0.1 or more. On the other hand, the magnesium alloy sheet of the present invention includes a large number of regions having a CI value of less than 0.1 (low-CI regions), which is one of the features of the sheet. More specifically, in the sheet, the low-CI region exists at an area proportion of 50% or more and less than 90%. In other words, when the magnesium alloy sheet of the present invention undergoes the EBSD measurement, the area on which the orientation imaging for the crystal grains cannot be performed precisely exists in 50% or more of the total area of the sheet. It is likely that the reason why the orientation imaging cannot be performed precisely is that the shear band, crystal defects such as dislocations and twin crystals, and the strain exercise their influence, apart from inadequacy in the preparation of the sample and improperness in the measuring condition. The inadequacy in the preparation of the sample includes the addition of a strain caused by the mechanical polishing and the contamination of the surface of the sample. The improperness in the measuring condition includes incorrect crystal system data to be used for the imaging, which has a great influence. The measures against the above-described inadequacy and improperness are described later.

Shape

The types of the magnesium alloy sheet of the present invention include a long sheet wound in the shape of a coil and a short sheet cut from the long sheet. In the long sheet, the direction of the length is usually parallel to the rolling direction. The short sheet typically has the shape of a rectangle (including a square), which is produced by cutting the long sheet in the direction perpendicular to the rolling direction. The cut rectangular sheet is sometimes cut further in the direction parallel to the rolling direction. The above-described cutting produces a rectangular sheet whose one side is in a direction parallel to the rolling direction and another side perpendicular to the one side is in a direction perpendicular to the rolling direction. The direction of the one side or the direction of the other side is coincident with the direction of the width of the sheet.

The thickness of the magnesium alloy sheet of the present invention can be varied by properly adjusting the working ratio at the time of rolling (the rolling reduction). For example, when the magnesium alloy sheet of the present invention is used as the material for the package of an electronic device as described later, it is desirable that the sheet have a thickness of 2 mm or less, more desirably 0.03 mm or more and 1.5 mm or less.

Residual Stress

The magnesium alloy sheet of the present invention has a compressive residual stress because a strain is given to the rolled sheet, which is also one of the features of the sheet. More specifically, on the surface of the sheet, a compressive residual stress exists in the direction of the width of the sheet or in a direction at an angle of 90 degrees toward the direction of the width of the sheet. In the case where the sheet is the above-described long sheet, the direction of the width of the sheet is defined as the direction perpendicular to the direction of the length (i.e., the rolling direction). In the case where the sheet is a short sheet having the shape of a rectangle, the direction of the width of the sheet is defined as the direction of any one side. In the case of a short sheet, when the rolling direction can be identified, the direction perpendicular to the rolling direction is defined as the direction of the width of the sheet.

When the rolling direction coincides with a direction at an angle of 90 degrees toward the direction of the width of the sheet (in the case of a long sheet, the direction of the length), the specific magnitude of the above-described compressive residual stress is 0 MPa or more and 100 MPa or less in the rolling direction (0 MPa is included in the compressive residual stress) and 0 MPa or more and 100 MPa or less in a direction at an angle of 90 degrees toward the rolling direction. If the compressive residual stress lies at the outside of the above-described range or a tensile residual stress exists, the elongation of the sheet cannot be increased to 100% or more under a warm condition (in a temperature range of 200° C. to 300° C.). As a result, it is difficult to perform a sufficient plastic deforming operation on various shapes. The value of this residual stress can be used as an indicator showing that the strain has been given.

C-Axis Orientation

The magnesium alloy sheet of the present invention intensely maintains the c-axis orientation of the rolled sheet, which is also one of the features of the sheet. The (0002) plane of a rolled sheet is generally aligned parallel to the rolling direction. Consequently, the c-axis of a rolled sheet is oriented so as to be perpendicular to the rolling direction. In other words, it is oriented to be perpendicular to the surface of the rolled sheet. The magnesium alloy sheet of the present invention practically maintains the above-described state of orientation of the rolled sheet. As a result, the indicator value of c-axis orientation is as large as 4.00 or more. In addition, the average inclining angle of the c-axis is as small as 5 degrees or less. The formed body of the present invention obtained by performing plastic forming on the above-described magnesium alloy sheet of the present invention is likely to maintain the state of orientation of the sheet and has a texture in which the c-axis is oriented nearly perpendicular to the surface of the formed body. Consequently, plastic deformation is less likely to occur in the direction of the thickness of the sheet. As a result, even when an impact such as the falling of an object is applied to the formed body of the present invention, a large dimple is less prone to develop.

Property Under a Warm Condition

The magnesium alloy sheet of the present invention has high elongation under a warm condition (in a temperature range of 200° C. or more and 300° C. or less). More specifically, it has an extremely high elongation: 100% or more at a temperature of 200° C. or higher, particularly, 200% or more at a temperature of 250° C. or higher, and further particularly, 300% or more at a temperature of 275° C. or higher. Having sufficient elongation under a warm condition as described above, the magnesium alloy sheet of the present invention is less likely to develop cracks and the like and has excellent plastic formability when the sheet undergoes warm plastic forming such as warm press forming.

In addition, the magnesium alloy sheet of the present invention has small anisotropy in the above-described elongation under a warm condition, which is also one of the features of the sheet. More specifically, when any given direction of the magnesium alloy sheet of the present invention is assumed to be zero degrees, the difference in elongation between the following four directions is small:

a first direction is the foregoing zero-degree direction, a second direction is a 45-degree direction which is inclined 45 degrees toward the zero-degree direction, a third direction is a 90-degree direction which is inclined 90 degrees toward the zero-degree direction (i.e., the direction is perpendicular to the zero-degree direction), and the fourth direction is a 135-degree direction which is inclined 135 degrees toward the zero-degree direction (i.e., the direction is perpendicular to the 45-degree direction).

In other words, the sheet has an elongation of 100% or more at 200° C. or higher in all of the foregoing four directions, and the individual elongations are comparable to one another. The same is applied to the cases of 250° C. or higher and 275° C. or higher. Having a small anisotropy as described above, the magnesium alloy sheet of the present invention is less likely to develop cracks and the like and has excellent plastic formability even when the sheet undergoes warm plastic forming in any direction.

Property at Ordinary Temperature

The magnesium alloy sheet of the present invention has excellent mechanical property (elongation, tensile strength, and 0.2% proof stress) at ordinary temperature (20° C.), which is also one of the features of the sheet. More specifically, at 20° C., the sheet has an elongation of 2.0% or more and 14.9% or less, a tensile strength of 350 MPa or more and 400 MPa or less, and a 0.2% proof stress of 250 MPa or more and 350 MPa or less. Because the magnesium alloy sheet of the present invention also has excellent mechanical property at ordinary temperature, the sheet is less likely to develop deformation and fracture and can be suitably used as a structural material.

Hardness

Because the magnesium alloy sheet of the present invention has a compressive residual stress, it tends to have higher hardness than that of a heat-treated material that has undergone a heat treatment aiming at recrystallization after the rolling operation. More specifically, the sheet has a Vickers hardness (Hv) of 85 or more and 105 or less. Because the magnesium alloy sheet of the present invention has relatively high hardness, the sheet is less likely to be damaged and can be suitably used as a structural material. The hardness can be used as an indicator showing that the strain has been given.

Composition

The magnesium alloy sheet of the present invention is composed of magnesium-based alloy that contains more than 50 mass % Mg as the base metal. The types of elements to be added to the base metal Mg include aluminum (Al), zinc (Zn), manganese (Mn), yttrium (Y), zirconium (Zr), copper (Cu), silver (Ag), silicon (Si), calcium (Ca), beryllium (Be), nickel (Ni), gold (Au), platinum (Pt), strontium (Sr), titanium (Ti), boron (B), bismuth (Bi), germanium (Ge), indium (In), terbium (Tb), neodymium (Nd), niobium (Nb), lanthanum (La), and the rare earth element (except Y, Nd, Tb, and La). Specific compositions are shown below (unit: mass %).

(1) An alloy that contains 1.0% or more and 10.0% or less Al, 0.1% or more and 1.5% or less Zn, and the remainder that is composed of Mg and unavoidable impurities, (2) An alloy that contains both at least one element selected from the group consisting of Al, Zn, Mn, Y, Zr, Cu, Ag, and Si with a total content of 0.01% or more and 20% or less and the remainder that is composed of Mg and unavoidable impurities, (3) An alloy that contains both at least one element selected from the group consisting of Ca and Be with a total content of 0.00001% or more and 16% or less and the remainder that is composed of Mg and unavoidable impurities, (4) An alloy that contains both at least one element selected from the group consisting of Ni, Au, Pt, Sr, Ti, B, Bi, Ge, In, Tb, Nd, Nb, La, and the rare earth element (except Tb, Nd, and La) with a total content of 0.001% or more and 5% or less and the remainder that is composed of Mg and unavoidable impurities, and (5) An alloy that contains both the alloy specified in (1) above and an added element that is composed of at least one element selected from the group consisting of the elements specified in (2), (3), and (4) above with the specified content.

A magnesium alloy containing Al has excellent corrosion resistance. In particular, an alloy containing 8.3 mass % or more and 9.5 mass % or less Al is desirable in terms of corrosion resistance and mechanical property. AZ10, AZ31, AZ61, AZ63, AZ80, AZ81, AZ91, and the like all specified in the Standards of American Society for Testing and Materials (ASTM) can be used as the Al-containing alloy. AS-family alloy and AM-family alloy both specified in ASTM Standards can be used as an alloy containing Mn or Si specified in (2) above in addition to Al. The element specified in (2) above is desirable in terms of corrosion resistance, heat resistance, and mechanical property. Ca and Be specified in (3) above can enhance the flame resistance of the alloy. The element specified in (4) above is desirable in terms of corrosion resistance and heat resistance.

Method of Producing the Magnesium Alloy Sheet

The above-described magnesium alloy sheet of the present invention can be obtained by giving a specified strain to a rolled sheet produced by rolling a material having the above-described composition.

Material

The material to be rolled can be, for example, a cast material in the shape of an ingot, an extruded material obtained by extruding a billet, and a continuously cast material obtained through, for example, the twin-roll process. In particular, the twin-roll process can perform rapid solidification at a solidification rate as high as 50 K/sec or more. The rapid solidification enables the production of a cast material low in internal defects such as oxides and segregated substances. The use of such a twin-roll-cast material can decrease the development of cracks and the like originating from the internal defects at the time of plastic forming. In particular, a magnesium alloy having a high Al content tends to produce impurities in crystal and precipitated impurities and segregation at the time of casting. Furthermore, even after undergoing steps of rolling and the like after the casting, the impurities in crystal and precipitated impurities and the segregated substances are likely to remain at the interior. Consequently, it is desirable to use the twin-roll-cast material as the material. It is desirable to employ a solidification rate of 200 K/sec or more, particularly desirably 300 K/sec or more, further particularly desirably 400 K/sec or more. The increase in the solidification rate can decrease the size of the impurities in crystal and precipitated impurities to 20 μm or less, causing them to be less likely to become the starting point of cracks. The thickness of the material can be selected as appropriate. When the twin-roll-cast material is used as the material, it is desirable that the material have a thickness of 0.1 mm or more and 10.0 mm or less.

The above-described material may be subjected to a solution heat treatment as appropriate before the rolling. The condition for the solution heat treatment is, for example, 380° C. or more and 420° C. or less for 60 minutes or more and 600 minutes or less, desirably 390° C. or more and 410° C. or less for 360 minutes or more and 600 minutes or less. The performing of the solution heat treatment can reduce the size of the segregated substances. In the case of the magnesium alloy having a high Al content, it is desirable to slightly increase the time period for the solution heat treatment.

Rolling Step

The rolling operation to be performed on the above-described material is typically divided into a rough rolling and a finishing rolling. When the rough rolling is performed under a condition that the material (work piece) directly before being inserted into the roll has a surface temperature (preheating temperature) of 300° C. or more and the roll has a surface temperature of 180° C. or more, even when the rolling reduction per pass is increased, edge cracks are less likely to develop, so that the efficiency is increased. It is desirable to set the surface temperature of the work piece at 300° C. or more and 360° C. or less and the surface temperature of the roll at 180° C. or more and 210° C. or less. For the rough rolling, it is desirable to set the rolling reduction per pass at 10% or more and 40% or less and the total rolling reduction at 75% or more and 85% or less.

Subsequent to the above-described rough rolling, the finishing rolling is performed. It is desirable that the finishing rolling be performed under a condition that the work piece directly before being inserted into the roll has a surface temperature (preheating temperature) of 140° C. or more and 250° C. or less and the roll has a surface temperature of 150° C. or more and 180° C. or less. In particular, in the case of the magnesium alloy having a high Al content, it is desirable to slightly increase the surface temperature of the work piece. For the finishing rolling, it is desirable to set the rolling reduction per pass at 5% or more and 20% or less and the total rolling reduction at 10% or more and 75% or less, particularly desirably 20% or more and 50% or less.

Each of the foregoing rough rolling and finishing rolling is performed with one pass or more, desirably two passes or more. In the case where the rolling operation is performed with a plurality of passes, when an intermediate annealing aiming at removing the strain is performed after every predetermined pass or passes, the subsequent rolling can be performed smoothly. The condition for the intermediate annealing is, for example, 250° C. or more and 350° C. or less for 20 minutes or more and 60 minutes or less. In addition, among the multiple passes of rolling, when at least one pass is performed by reversing the rolling direction from that of the other pass or passes, the work strain given to the work piece is likely to become uniform.

Strain-Giving Step

A predetermined strain is given to the rolled sheet having undergone the above-described rolling step. Before giving the strain after the final rolling operation, the rolled sheet is not subjected to a heat treatment that aims at recrystallization. In addition, a heat treatment aiming at recrystallization is not performed on the work piece before the warm plastic forming after the giving of a strain. When the heat treatment aiming at recrystallization is performed, the effect of improving the plastic formability resulting from the development of continuous recrystallization at the time of plastic forming cannot be sufficiently achieved.

The strain is given while the rolled sheet is being heated. More specifically, it is desirable that the heating be performed at a temperature of 100° C. or more and 250° C. or less. If the heating is performed at a temperature lower than 100° C. including ordinary temperature, an excessive amount of strain is given, increasing the dislocation density during the warm plastic forming. As a result, work hardening is created and consequently the sheet becomes easily fractured. In addition, the rolled sheet may develop cracks and the like at the time of giving a strain. If the heating is performed at a temperature higher than 250° C., the amount of given strain is small, so that the continuous recrystallization is less likely to develop during the warm plastic forming. It is more desirable that the heating be performed at a temperature of 150° C. or more and 200° C. or less. The heating of the rolled sheet is performed, for example, by blowing hot air.

In addition to the heating of the rolled sheet, it is desirable to heat the means for giving a strain. More specifically, it is desirable that the heating be performed at a temperature of 150° C. or more and 300° C. or less. If the heating is performed at a temperature lower than 150° C. including ordinary temperature, it is difficult to maintain the rolled sheet at a desired temperature. As a result, the temperature of the rolled sheet is decreased and consequently as described above, an excessive amount of strain tends to be given. If the heating is performed at a temperature higher than 300° C., the temperature of the rolled sheet is increased and consequently as described above, the amount of given strain tends to become small. It is more desirable that the heating be performed at a temperature of 200° C. or more and 250° C. or less.

A strain is given to the rolled sheet, heated as described above, by using a strain-giving means such that the sheet after acquiring the strain has a half peak width of 0.20 deg or more and 0.59 deg or less in the (0004) diffraction peak in monochromatic X-ray diffraction. In particular, it is desirable to give the strain such that the low-CI region exists at an area proportion of 50% or more and less than 90%. A specific strain-giving means is, for example, the one that is provided with at least one roller and gives bending to the rolled sheet using the roller. In particular, it is desirable to use a means that can give repeated bending to the rolled sheet by passing it between two rows of staggered rollers. When the foregoing roller is provided with a heating means such as a heater, the heating of the strain-giving means can be easily performed. The amount of strain can be controlled by changing the size of the roller and the number of rollers and by adjusting the spacing between the rollers and the like.

Formed Body

A magnesium alloy formed body of the present invention can be obtained by performing plastic forming on the magnesium alloy sheet of the present invention under a warm condition in the range of 200° C. or more. When subjected to warm plastic forming, the magnesium alloy sheet of the present invention develops continuous recrystallization and consequently promotes fine recrystallization. As a result, the formed body of the present invention has a fine recrystallized texture. In other words, although it is difficult to measure the crystal grain size of the magnesium alloy sheet of the present invention, when the sheet is transformed into a formed body of the present invention, the measurement of the crystal grain size becomes possible. More specifically, the formed body of the present invention has an average crystal grain size of 0.5 μm or more and 5 μm or less. Having such a fine recrystallized texture, the formed body of the present invention has high mechanical strength.

Plastic Forming

As described above, to obtain the magnesium alloy formed body of the present invention, the magnesium alloy sheet of the present invention is subjected to plastic forming. The plastic forming is performed employing at least one of the following methods: press forming, deep drawing, forging, blow forming, and bending. Through these various types of plastic forming, the formed body of the present invention having a different shape can be obtained.

After the plastic forming, a heat treatment may be conducted for the purpose of removing the strain resulting from the plastic forming, removing the residual stress introduced at the time of the plastic forming, improving the mechanical property, implementing the solution treatment, and so on. The heat treatment is performed, for example, at a temperature of 100° C. or more and 450° C. or less and a time period of 5 minutes or more and 40 hours or less. It is recommended that the temperature and time period be properly selected according to the purpose.

After the plastic forming, when an anticorrosion treatment (a chemical-conversion treatment or anodic-oxidation treatment) and a coating treatment are conducted on the formed body, it can have increased corrosion resistance and high commercial value.

Applied Examples of the Formed Body

In particular, the formed body of the present invention subjected to press forming is suitable for the package of an electronic device. More specifically, the examples of packages include the package of a mobile electronic device such as a cellular phone, handheld terminal, notebook personal computer, personal digital assistance, camera, and portable music player and the package of a liquid-crystal TV display and plasma TV display. Furthermore, the magnesium alloy formed body of the present invention can also be applied to an outer panel of a transportation machine such as a motorcar, aircraft, and railway vehicle; an interior finishing material such as a sheet panel; an engine component; a component around a chassis; the frame of a pair of spectacles; and structural members including a metallic tube and pipe for forming a muffler of a motorcycle or the like.

Advantageous Effect of Invention

The magnesium alloy sheet of the present invention has excellent warm plastic form ability. The magnesium alloy formed body of the present invention produced by performing warm plastic forming on the sheet has high strength and therefore is resistant to an impact. The method of the present invention for producing a magnesium alloy sheet can produce the foregoing magnesium alloy sheet of the present invention with high productivity.

BRIEF DESCRIPTION OF THE DRAWING

Part (I) of FIG. 1 is a schematic structural diagram schematically showing an example of a strain-giving means to be used in the production of the magnesium alloy sheet of the present invention, and Part (II) of FIG. 1 is an enlarged illustration of the roll portion.

Part (I) of FIG. 2 is a microscope photograph of the texture of Sample No. 4, Part (II) of FIG. 2 is that of Sample No. 101, and Part (III) of FIG. 2 is that of Sample No. 4 after a warm tensile test at 275° C.

REFERENCE SIGN LIST

Figure 1:
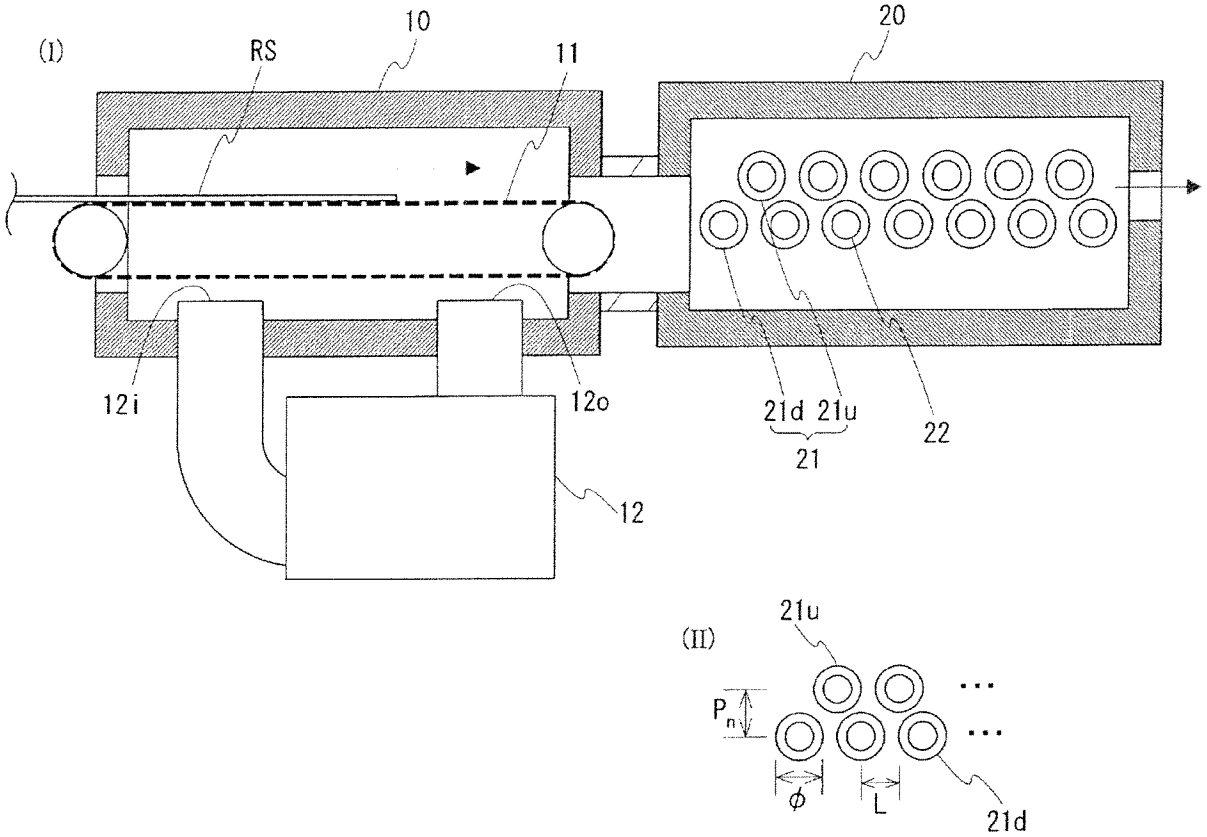

10: Heating furnace; 11: Conveyance portion; 12: Circulation-type hot-air-generating means; 12*i*: Inlet; 12*o*: Outlet; 20: Roll portion; 21: Roll; 21*u*: Upside roll; 21*d*: Downside roll; 22: Heater; and RS: Rolled sheet.

DESCRIPTION OF THE PREFERRED EMBODIMENTS

Test Example 1

Magnesium Alloy Sheet

Rolled sheets composed of magnesium alloy having the composition shown in Table I were produced. Samples were produced by heat-treating some of the rolled sheets or by giving a strain to some of the rolled sheets. Then, various properties were examined.

The rolled sheet is produced as described below. A magnesium alloy having the composition shown in Table I (remainder: Mg and unavoidable impurities) is prepared. A cast sheet having a thickness of 4.0 mm is produced by using a twin-roll continuous casting machine (solidification rate: 50 K/sec or more). The cast sheet is subjected to rough rolling to produce a rough-rolled sheet having a thickness of 1.0 mm (total rolling reduction in rough rolling: 75%). The rough rolling is performed by, first, preheating the work piece, which is the cast sheet, at 360° C. and, then, conducting a plurality of passes (in this case: six passes) using a roll having a surface temperature of 200° C. Subsequently, the rough-rolled sheet is subjected to finishing rolling to produce a finishing-rolled sheet having a thickness of 0.6 mm (total rolling reduction in finishing rolling: 40%). The finishing rolling is performed by, first, preheating the work piece, which is the rough-rolled sheet, at 240° C. and, then, conducting a plurality of passes (in this case: four passes) using a roll having a surface temperature of 180° C.

Sample Nos. 1 to 11

A strain is given to the rolled sheet having a thickness of 0.6 mm obtained through the above-described rolling step. The strain is given using a strain-giving means shown in FIG. 1 as an example. The strain-giving means is provided with a heating furnace 10 for heating a rolled sheet RS and a roll portion 20 having rolls 21 for continuously giving bending to the heated rolled sheet RS. The heating furnace 10 is placed at the upstream side, and the roll portion 20 is placed at the downstream side. The heating furnace 10 is a hollow cylindrical body having an opening at both ends. A conveyance portion (in this case, a belt conveyor) 11 is placed at the inside of the heating furnace 10 to convey the rolled sheet RS to the roll portion 20 at the downstream side. The conveyance portion 11 conveys the rolled sheet RS from the opening at one end (the upstream side) toward the opening at the other end (the downstream side). The heating furnace 10 is connected with a circulation-type hot-air-generating means 12. Hot air having a predetermined temperature is introduced into the heating furnace 10 from an inlet 12*i* of the circulation-type hot-air-generating means 12. The hot air is exhausted from the heating furnace 10 through an outlet 12*o*. The exhausted hot air is adjusted so as to have the predetermined temperature in the circulation-type hot-air-generating means 12. The hot air adjusted so as to have the predetermined temperature is introduced into the heating furnace 10 again. The roll portion 20 is also a hollow cylindrical body having an opening at both ends. The opening at one end (the upstream side) is directly connected to the opening at the downstream side of the heating furnace 10. The rolled sheet RS conveyed by the conveyance portion 11 is sent into the roll portion 20 through the opening at the upstream side. At the inside of the roll portion 20, a plurality of rolls 21 are placed in a staggered format. The rolled sheet RS having entered the roll portion 20 is introduced into the position between the opposed rolls 21. Every time it passes between the rolls 21, it is subjected successively to the bending given by the rolls 21. While undergoing the bending, it is sent to the opening at the downstream side. The individual roll 21 is equipped with an embedded bar-shaped heater 22, so that the roll 21 can heat itself.

In this case, the roll portion 20 was provided with twenty upside rolls 21*u* and twenty-one downside rolls 21*d*, in total forty-one rolls 21 (FIG. 1 shows a diagram simplified in the number of rolls). The individual roll 21 has a diameter of 40 mm, and the horizontal distance L between the centers of the upside roll 21*u* and the downside roll 21*d* is 43 mm. The roll spacing $P_n$ (the vertical distance between the centers of the upside roll 21*u* and the downside roll 21*d*) varies linearly from the upstream side of the roll portion 20 toward its downstream side (n=1, 2, . . . , 20). More specifically, the roll spacing becomes narrower as the position moves toward the upstream side and becomes wider as the position moves toward the downstream side. The roll spacing $P_1$ at the side from which the rolled sheet RS conveyed from the heating furnace 10 is introduced is 39 mm, and the roll spacing $P_{20}$ at the side from which the rolled sheet RS having passed between the rolls 21 is discharged to the outside is 41 mm. In this case, the roll portion may use a roll leveler.

By using the strain-giving means as shown in FIG. 1, a strain is given to the rolled sheet under the strain-giving condition shown in Table I (the roll temperature (° C.) and the rolled-sheet temperature (° C.)). The number of times of the giving of a strain is counted such that when the rolled sheet has passed the foregoing strain-giving means once, the number is counted as one. The rolled sheets to which a strain has been given as described above are designated as Sample Nos. 1 to 11.

In this case, Sample Nos. 1 to 11 and Sample No. 102, which is described below, have not been subjected to a heat treatment aiming at recrystallization (the below-described annealing) both before the giving of a strain after the rolling operation and after the giving of a strain.

Sample Nos. 100 to 103

Sample No. 100 is an as-rolled rolled sheet having a thickness of 0.6 mm obtained through the above-described rolling step. Sample No. 101 was produced by, first, annealing (at 320° C. for 20 minutes) a rolled sheet and, then, performing the above-described giving of a strain once. Sample No. 102 was produced by performing the above-described giving of a strain twice on a rolled sheet, without performing the above-described annealing. Sample No. 103 was produced by only performing the above-described annealing on a rolled sheet, without performing the above-described giving of a strain afterward.

TABLE I

| | Composition: | Performing or not | Strain-giving condition | | |
|---|---|---|---|---|---|
| Sample No. | Added element (mass %) | performing of annealing after rolling | Number of times | Roll temperature (° C.) | Rolled-sheet temperature (° C.) |
| 1 | Al: 9%; Zn: 1% | Not performing | 1 | 100 | 200 |
| 2 | Al: 9%; Zn: 1% | Not performing | 1 | 150 | 200 |
| 3 | Al: 9%; Zn: 1% | Not performing | 1 | 200 | 200 |
| 4 | Al: 9%; Zn: 1% | Not performing | 1 | 250 | 200 |
| 5 | Al: 9%; Zn: 1% | Not performing | 1 | 300 | 200 |
| 6 | Al: 9%; Zn: 1% | Not performing | 1 | 320 | 200 |
| 7 | Al: 9%; Zn: 1% | Not performing | 1 | 250 | 80 |

TABLE I-continued

| Sample No. | Composition: Added element (mass %) | Performing or not performing of annealing after rolling | Strain-giving condition: Number of times | Roll temperature (° C.) | Rolled-sheet temperature (° C.) |
|---|---|---|---|---|---|
| 8 | Al: 9%; Zn: 1% | Not performing | 1 | 250 | 100 |
| 9 | Al: 9%; Zn: 1% | Not performing | 1 | 250 | 150 |
| 10 | Al: 9%; Zn: 1% | Not performing | 1 | 250 | 250 |
| 11 | Al: 9%; Zn: 1% | Not performing | 1 | 250 | 280 |
| 100 | Al: 9%; Zn: 1% | Not performing | 0 | — | — |
| 101 | Al: 9%; Zn: 1% | Performing | 1 | 250 | 200 |
| 102 | Al: 9%; Zn: 1% | Not performing | 2 | 250 | 200 |
| 103 | Al: 9%; Zn: 1% | Performing | 0 | — | — |

The obtained samples were subjected to the examination for the following properties: the half peak width (deg) in the (0004) diffraction peak in monochromatic X-ray diffraction, the residual stress (MPa), the area proportion (%) of the low-CI region, the indicator value of c-axis orientation, the average c-axis inclining angle (degree), the crystal grain size (μm), and the Vickers hardness (Hv). The results are shown in Table II. The measurement of the foregoing properties was conducted using a rectangular test piece prepared by cutting the individual sample as appropriate. The test piece was prepared such that the direction of the long side is parallel to the rolling direction and the direction of the short side (the direction of the width of the sheet) is in a direction at an angle of 90 degrees toward the rolling direction.

The half peak width (deg) was evaluated by measuring the half peak width (deg) in the (0004) diffraction peak obtained by using monochromatic X-rays generated from an X-ray diffractometer described below. In the above description, the term "monochromatic X-rays" is used to mean "irradiation X-rays" produced by decreasing the intensity of the Cu—K$\alpha_2$ line with a hybrid mirror system mounted on the X-ray diffractometer X'pert Pro made by Royal Philips Electronics, NL to such an extent that the intensity becomes negligible (0.1% or less). The measuring conditions are shown below.

Equipment used: X-ray diffractometer (X'pert Pro made by Royal Philips Electronics, NL)

X-rays used: Cu—K$\alpha$ line focus

Excitation condition: 45 kV; 40 mA

Incident optical system: hybrid mirror

Receiving optical system: plate collimator 0.27

Scanning method: $\theta$–$2\theta$ scan

Measuring range: $2\theta$=72 to 76 degrees (step width: 0.02 degrees).

The residual stress was measured through the $\sin^2\Psi$ method using the (1004) plane as the measuring plane by using the micropart X-ray stress-measuring equipment described below. The measurement was conducted both on the rolling direction and on the direction at an angle of 90 degrees toward the rolling direction (the direction perpendicular to the rolling direction) of the individual test piece. In Table II, the figure with a minus sign (−) shows a compressive residual stress and the figure with a plus sign (+) shows a tensile residual stress. In this case, the residual stress "zero" is included in the compressive residual stress. The measuring conditions are shown below.

Equipment used: micropart X-ray stress-measuring equipment (MSF-SYSTEM made by Rigaku Corporation)

X-rays used: Cu—K$\alpha$ (V filter)

Excitation condition: 30 kV; 20 mA

Measuring region: diameter: 2 mm (the diameter of the collimator used)

Measuring method: $\sin^2\Psi$ method (the isoinclination method, with oscillation)

$\Psi$: 0, 10, 15, 20, 25, 30, 35, 40, and 45 degrees

Measured plane: Mg (1004) plane

Constant used: Young's modulus: 45,000 MPa; Poisson ratio: 0.306

Measured position: center portion of the sample

Measured direction: rolling direction and the direction perpendicular to the rolling direction The area proportion (%) of the low-CI region was obtained through the following method. First, the sample was subjected to the EBSD measurement. The area of the region where the confidence index (the CI value) is less than 0.1 (the low-CI region) is measured. The proportion of the area of the low-CI region to the total area of the measured region was obtained. Then, the evaluation was performed. To prevent inadequacy in the preparation of the sample, the sample was prepared through a method in which a new strain is not given in addition to the stain given by the above-described strain-giving means. More specifically, an ion-beam cross-section sample preparation device (Cross Section Polisher made by JEOL Ltd.) was used that can shave off the surface portion of the sample using an Ar-ion beam in a vacuum. The prepared sample was taken out of the foregoing sample preparation device, and within five minutes of the taking out, the sample was introduced into an EBSD measurement device to perform the EBSD measurement. Furthermore, to prevent inadequacy in the measuring condition, at the time of the crystal analysis in the EBSD measurement, as the crystal system data, magnesium in the data base supplied by TSL Solutions K.K was used. In addition, in the magnesium alloy, Mg forming the mother phase contains various inclusions including added elements (Al, Zn, and the like). Although the portion of the inclusions has a low CI value, in the measurement of this test, the decrease in the CI value caused by the presence of these inclusions is not taken into consideration. The measuring conditions are shown below.

Equipment used: scanning electron microscope (SEM) (SUPRA35VP made by Carl Zeiss SMT Inc.)

electron back scattering diffractometer (EBSD device) (OIM5.2 made by TSL Solutions K.K)

Acceleration voltage: 15 kV; Irradiation current: 2.3 nA; Inclining angle of the sample: 70 degrees; WD: 20 mm Crystal system data: magnesium Observation magnification: 400 times EBSD measuring region: 120 μm×300 μm (0.5-μm spacing).

The indicator value of c-axis orientation was obtained by the following method. First, a magnesium alloy powder having the same composition as that of the individual sample was subjected to X-ray diffraction. The ratio of the (0002) diffraction intensity of the individual sample to that of the obtained magnesium alloy powder was calculated to perform the evaluation. More specifically, the individual sample and the magnesium alloy powder were subjected to the measurement for the following data: the (0002) diffraction intensity: $I_{(0002)}$; the (1000) diffraction intensity: $I_{(1000)}$; the (1001) diffraction intensity: $I_{(1001)}$; the (1100) diffraction intensity: $I_{(1100)}$; the (1003) diffraction intensity: $I_{(1003)}$; and the (1004) diffraction intensity: $I_{(1004)}$. Then, the total intensity $I_{total}$ of these is calculated as follows: $I_{total}=I_{(0002)}+I_{(1000)}+I_{(1001)}+I_{(1100)}+I_{(1003)}+I_{(1004)}$. Finally, the value obtained by calculating the following formula is defined as the indicator value of c-axis orientation:

($I_{(0002)}$ of the sample/$I_{total}$ of the sample)/($I_{(0002)}$ of the magnesium alloy powder/$I_{total}$ of the magnesium alloy powder)

The measuring conditions are shown below.

Equipment used: X-ray diffractometer (LINT-1500 made by Rigaku Corporation)

X-rays used: Cu—Kα

Excitation condition: 50 kV; 200 mA

Slit: DS: 1 degree; RS: 0.15 mm; SS: 1 degree

Measuring method: θ−2θ measurement

Measuring condition: 6 degrees/min (measuring interval: 0.02 degrees)

Measured position: rolled surface

The average c-axis inclining angle was evaluated by the pole figures measurement using an X-ray diffractometer. The measuring conditions are shown below.

Equipment used: X-ray diffractometer (X'pert Pro made by Royal Philips Electronics, NL)

X-rays used: Cu—Kα

Excitation condition: 45 kV; 40 mA

Measuring region: diameter: 1 mm (diameter of the collimator used)

Measuring method: pole figures measurement; Mg (0002) plane

Measuring condition: measuring interval: 5 degrees

Measured position: rolled surface

The crystal grain size was obtained based on the calculation formula stated in JIS G 0551 (2005). More specifically, first, the sample piece was cut. The cut surface underwent buffing (diamond abrasive grain used: No. 200). An etching treatment was performed. The texture observation was conducted under an optical microscope with a field of view magnified at 400 times. Finally, the average crystal grain size was measured using the line method (a cutting method using test lines). In the texture observation, the sample for which the measurement of the crystal grain size was impossible because of unclear crystal grain boundaries is shown as "ND" in Table II. The same is applied to Table VI described later.

The Vickers hardness (Hv) was obtained through the following method. First, a longitudinal section was obtained by cutting the test piece (thickness: 0.6 mm) along its long side. A lateral section was obtained by cutting the test piece along its short side. Vickers hardness was measured at a plurality of points in the central portion of the longitudinal and lateral sections excluding the surface portion from the surface to the position 0.05 mm away from the surface. In this case, five data were taken for each section, i.e., 10 data in total, to calculate the average value.

In addition, the following properties were examined: mechanical properties at 20° C. (elongation (%), tensile strength (MPa), and 0.2% proof stress (MPa)) and elongation (%) at warm temperature regions. The results are shown in Tables III and IV.

The mechanical properties at 20° C. were examined in accordance with the tensile test stated in JIS Z 2241 (1998). In this case, the individual sample was cut to prepare the No. 13B test piece stated in JIS Z 2201 (1998) to carry out the tensile test. A plurality of test pieces were prepared for the individual sample such that the longitudinal direction of a test piece has a different inclination toward the rolling direction. More specifically, the following test pieces were prepared for the individual sample: a test piece prepared such that the longitudinal direction is parallel to the rolling direction (direction of tensile test: 0 degrees); a test piece prepared such that the longitudinal direction is inclined toward the rolling direction at 45 degrees (direction of tensile test: 45 degrees); a test piece prepared such that the longitudinal direction is inclined toward the rolling direction at 90 degrees, i.e., perpendicular to the rolling direction (direction of tensile test: 90 degrees); and a test piece prepared such that the longitudinal direction is inclined toward the rolling direction at 135 degrees (direction of tensile test: 135 degrees).

TABLE II

| Sample No. | Crystal grain size (μm) | Indicator value of c-axis orientation | Average c-axis inclining angle (degree) | Area proportion of low-CI region (%) | Half peak width in (0004) diffraction peak in monochromatic X-ray diffraction (deg) | Residual stress (MPa) Rolling direction | Residual stress (MPa) 90-degree direction toward rolling direction | Vickers hardness (Hv) |
|---|---|---|---|---|---|---|---|---|
| 1 | ND | 4.90 | 5 degrees or less | 91 | 0.61 | −103 | −105 | 106 |
| 2 | ND | 4.80 | 5 degrees or less | 89 | 0.59 | −93 | −96 | 105 |
| 3 | ND | 4.76 | 5 degrees or less | 86 | 0.54 | −60 | −63 | 97 |
| 4 | ND | 4.69 | 5 degrees or less | 81 | 0.39 | −26 | −34 | 95 |
| 5 | ND | 4.31 | 5 degrees or less | 79 | 0.27 | −10 | −16 | 88 |
| 6 | ND | 4.21 | 5 degrees or less | 52 | 0.17 | +3 | +1 | 84 |
| 7 | ND | 4.85 | 5 degrees or less | 90 | 0.60 | −102 | −103 | 106 |
| 8 | ND | 4.76 | 5 degrees or less | 88 | 0.47 | −75 | −82 | 102 |
| 9 | ND | 4.70 | 5 degrees or less | 84 | 0.43 | −56 | −58 | 96 |
| 10 | ND | 4.53 | 5 degrees or less | 69 | 0.23 | −2 | −5 | 88 |
| 11 | ND | 4.17 | 5 degrees or less | 49 | 0.16 | +5 | +2 | 83 |
| 100 | ND | 5.10 | 5 degrees or less | 92 | 0.62 | −110 | −108 | 108 |
| 101 | 5.6 | 4.26 | 5 degrees or less | 13 | 0.13 | +10 | +4 | 81 |
| 102 | ND | 3.13 | 5.2 degrees | 35 | 0.14 | +2 | +2 | 84 |
| 103 | 5.8 | 4.68 | 5 degrees or less | 12 | 0.12 | +12 | +3 | 80 |

TABLE III

| Sample No. | Direction of tensile test | Tensile test (20° C.) Elongation (%) | Tensile strength (MPa) | 0.2% proof stress (MPa) | Tensile test: Elongation (%) 200° C. | 250° C. | 275° C. |
|---|---|---|---|---|---|---|---|
| 1 | 0 degrees | 1.8 | 411 | 355 | 113 | 209 | 299 |
| | 90 degrees | 1.7 | 423 | 361 | 108 | 211 | 293 |
| | 45 degrees | 1.6 | 416 | 356 | 96 | 189 | 249 |
| | 135 degrees | 1.6 | 419 | 359 | 94 | 185 | 246 |
| 2 | 0 degrees | 2.0 | 399 | 346 | 134 | 231 | 331 |
| | 90 degrees | 2.5 | 395 | 346 | 111 | 239 | 327 |
| | 45 degrees | 3.1 | 397 | 349 | 106 | 221 | 302 |
| | 135 degrees | 2.9 | 398 | 350 | 104 | 224 | 306 |
| 3 | 0 degrees | 6.8 | 376 | 310 | 151 | 273 | 386 |
| | 90 degrees | 7.0 | 379 | 312 | 122 | 279 | 363 |
| | 45 degrees | 8.5 | 381 | 309 | 119 | 240 | 323 |
| | 135 degrees | 8.4 | 376 | 308 | 116 | 249 | 330 |
| 4 | 0 degrees | 9.6 | 367 | 300 | 143 | 264 | 341 |
| | 90 degrees | 9.8 | 360 | 301 | 118 | 275 | 333 |
| | 45 degrees | 9.5 | 363 | 296 | 111 | 237 | 306 |
| | 135 degrees | 9.2 | 365 | 297 | 113 | 241 | 308 |
| 5 | 0 degrees | 14.5 | 355 | 276 | 132 | 233 | 323 |
| | 90 degrees | 14.6 | 351 | 273 | 113 | 236 | 311 |
| | 45 degrees | 14.9 | 356 | 269 | 102 | 213 | 303 |
| | 135 degrees | 14.9 | 355 | 264 | 101 | 209 | 301 |
| 6 | 0 degrees | 15.1 | 349 | 249 | 121 | 198 | 296 |
| | 90 degrees | 15.0 | 342 | 239 | 99 | 201 | 286 |
| | 45 degrees | 15.4 | 347 | 247 | 97 | 189 | 267 |
| | 135 degrees | 15.4 | 348 | 249 | 96 | 185 | 264 |
| 7 | 0 degrees | 1.5 | 425 | 363 | 109 | 189 | 287 |
| | 90 degrees | 1.7 | 423 | 362 | 98 | 199 | 296 |
| | 45 degrees | 1.8 | 419 | 359 | 89 | 178 | 279 |
| | 135 degrees | 1.7 | 420 | 356 | 84 | 173 | 272 |
| 8 | 0 degrees | 2.3 | 391 | 343 | 113 | 214 | 321 |
| | 90 degrees | 2.5 | 390 | 339 | 109 | 209 | 309 |
| | 45 degrees | 2.3 | 389 | 338 | 101 | 204 | 304 |
| | 135 degrees | 2.3 | 390 | 340 | 102 | 205 | 301 |
| 9 | 0 degrees | 5.6 | 380 | 331 | 150 | 269 | 371 |
| | 90 degrees | 5.4 | 380 | 335 | 126 | 279 | 364 |
| | 45 degrees | 5.1 | 384 | 330 | 121 | 254 | 313 |
| | 135 degrees | 5.5 | 382 | 333 | 120 | 251 | 312 |
| 10 | 0 degrees | 11.3 | 351 | 281 | 135 | 229 | 330 |
| | 90 degrees | 11.0 | 353 | 283 | 117 | 231 | 315 |
| | 45 degrees | 11.5 | 355 | 277 | 109 | 225 | 309 |
| | 135 degrees | 11.0 | 356 | 279 | 104 | 219 | 303 |

TABLE IV

| Sample No. | Direction of tensile test | Tensile test (20° C.) Elongation (%) | Tensile strength (MPa) | 0.2% proof stress (MPa) | Tensile test: Elongation (%) 200° C. | 250° C. | 275° C. |
|---|---|---|---|---|---|---|---|
| 11 | 0 degrees | 15.1 | 349 | 246 | 119 | 201 | 293 |
| | 90 degrees | 15.3 | 346 | 243 | 109 | 197 | 291 |
| | 45 degrees | 15.1 | 347 | 248 | 95 | 183 | 281 |
| | 135 degrees | 15.6 | 343 | 248 | 93 | 176 | 276 |
| 100 | 0 degrees | 1.4 | 423 | 371 | 207 | 225 | 237 |
| | 90 degrees | 1.5 | 433 | 374 | 79 | 66 | 59 |
| | 45 degrees | 1.8 | 414 | 373 | 170 | 149 | 124 |
| | 135 degrees | 1.7 | 412 | 369 | 160 | 150 | 121 |
| 101 | 0 degrees | 16 | 349 | 243 | 163 | 130 | 103 |
| | 90 degrees | 17 | 338 | 246 | 64 | 97 | 101 |
| | 45 degrees | 16 | 343 | 239 | 148 | 111 | 102 |
| | 135 degrees | 16 | 342 | 239 | 145 | 109 | 101 |
| 102 | 0 degrees | 15.1 | 349 | 249 | 119 | 176 | 263 |
| | 90 degrees | 15.3 | 346 | 246 | 98 | 163 | 254 |
| | 45 degrees | 15.4 | 332 | 243 | 101 | 151 | 221 |
| | 135 degrees | 15.1 | 333 | 246 | 102 | 150 | 219 |
| 103 | 0 degrees | 17 | 346 | 238 | 160 | 129 | 105 |
| | 90 degrees | 16 | 336 | 237 | 60 | 98 | 99 |

TABLE IV-continued

| Sample No. | Direction of tensile test | Tensile test (20° C.) Elongation (%) | Tensile strength (MPa) | 0.2% proof stress (MPa) | Tensile test: Elongation (%) 200° C. | 250° C. | 275° C. |
|---|---|---|---|---|---|---|---|
| | 45 degrees | 16 | 341 | 235 | 143 | 110 | 101 |
| | 135 degrees | 16 | 342 | 232 | 142 | 110 | 99 |

Figure 2:
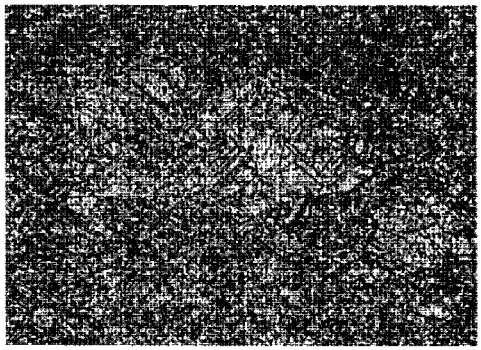
Figure 2:
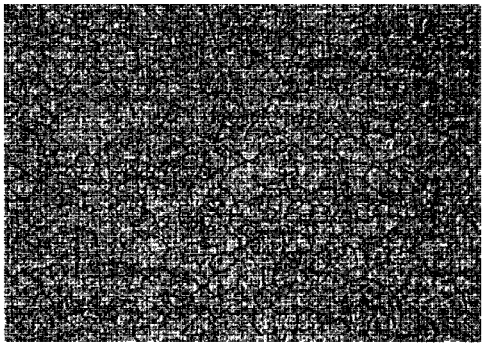
Figure 2:
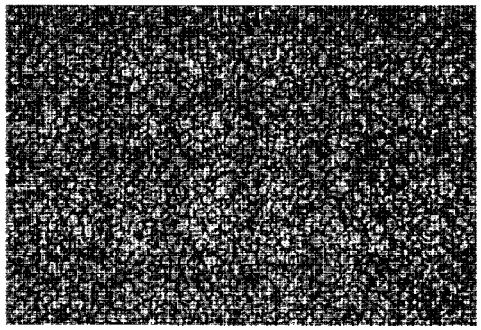

As shown in Table II, in the sample to which a strain was given such that the half peak width in the (0004) diffraction peak in monochromatic X-ray diffraction became 0.20 deg or more and 0.59 deg or less, the low-CI region has an area proportion of 50% or more and less than 90%. Consequently, it appears that this sample has a texture difficult to perform orientation imaging precisely, i.e., a texture in which the crystal grain is unclear. An actual examination of the texture reveals that as shown in Part (I) of FIG. 2, the foregoing sample whose half peak width falls within the range of 0.20 to 0.59 deg has unclear crystal grain boundaries, making it difficult to discern the crystal grain (Part (I) of FIG. 2 shows the texture of Sample No. 4). In contrast, in Sample 101 to which a strain was given after the annealing was performed, as shown in Part (II) of FIG. 2, the crystal grain boundary is clear and consequently the crystal grain can be discerned. It is likely that because in Sample No. 101, recrystallization is promoted by the annealing, even when the strain is given after the annealing, the recrystallized texture is maintained.

In addition, Samples whose half peak width described above falls within the range of 0.20 to 0.59 deg all have a compressive residual stress and a relatively high Vickers hardness. Furthermore, these samples not only have an indicator value of c-axis orientation as high as 4.00 or more but also have an average c-axis inclining angle of five degrees or less, showing that the state of orientation of the as-rolled rolled sheet (Sample No. 100) is firmly maintained.

In addition, as shown in Table III, Samples whose half peak width described above falls within the range of 0.20 to 0.59 deg have a high elongation under a warm condition in any of the following directions of the tensile test: 0, 45, 90, and 135 degrees. Furthermore, all of the elongations have a comparable value without regard to the direction, showing a small anisotropy. On the other hand, Sample No. 100, which is the as-rolled rolled sheet, has a large difference in elongation under a warm condition between, in particular, zero and 90 degrees as shown in Table IV, showing a large anisotropy. Sample No. 101, which has undergone the annealing, also has a large anisotropy in elongation under a warm condition at 250° C. or below.

In addition, the texture observation of Sample No. 4 after the tensile test at 275° C. reveals that the sample has a fine crystal texture (recrystallized texture) as shown in Part (III) of FIG. 2. This result supports the fact that Samples whose half peak width described above falls within the range of 0.20 deg or more and 0.59 deg or less develop recrystallization at the time of warm plastic forming.

In addition, Samples whose half peak width described above falls within the range of 0.20 to 0.59 deg have sufficient mechanical properties at 20° C. as shown in Table III.

The above test results show that when not only is a strain given to a rolled sheet such that the half peak width in the (0004) diffraction peak becomes 0.20 deg or more and 0.59 deg or less in monochromatic X-ray diffraction but also a heat treatment aiming at recrystallization is not performed before and after the giving of a strain, a magnesium alloy sheet having excellent elongation under a warm condition can be obtained. It can be expected that such a magnesium alloy sheet has excellent warm plastic formability.

Magnesium Alloy Formed Body

Formed bodies were produced by performing warm press forming (at 200° C., 250° C., and 275° C.) on sheets obtained by properly cutting Sample Nos. 4 and 103, described above. The formed body had the shape of a box having a length of 100 mm, a width of 100 mm, and a depth of 50 mm, with a cross-sectional shape of]. In this box, the corner portion formed by the neighboring side faces had an outside radius of curvature of 5 mm and the corner portion formed by the bottom face and the side face had an inside radius of curvature of 0 mm. The press forming was performed using a die assembly (a punch and a die) having an embedded heater. More specifically, the punch and die were heated with the heater up to a predetermined temperature (any of the temperatures 200° C., 250° C., and 275° C.). The sheet of the individual samples was placed between the punch and die. The sheet was held until its temperature reached the same temperature as that of the die assembly. Then, the die assembly was pressed to form a formed body.

The results showed that the sheet of Sample No. 4 did not develop cracks and the like in any of the forming operations at 200° C., 250° C., and 275° C. On the other hand, the sheet of Sample No. 103 developed a discernible crack in one area at 200° C., although it did not develop cracks and the like when the temperature was high (250° C. and 275° C.).

The above test results show that the magnesium alloy sheet to which a strain is given such that the half peak width in the (0004) diffraction peak becomes 0.20 deg or more and 0.59 deg or less in monochromatic X-ray diffraction has excellent warm plastic formability.

Test Example 2

Magnesium alloys having compositions different from that of Test example 1 were prepared to produce rolled sheets. The rolled sheets to which a strain was given were subjected to the examination for the following properties: the half peak width (deg) in the (0004) diffraction peak in monochromatic X-ray diffraction, the residual stress (MPa), the area proportion (%) of the low-CI region, the indicator value of c-axis orientation, the average c-axis inclining angle (degree), the crystal grain size (μm), and the Vickers hardness (Hv).

The rolled sheets were produced by, first, preparing magnesium alloys having the composition shown in Table V and, then, performing twin-roll casting and rolling under the same condition as used in Test example 1. A strain was given to the obtained rolled sheets under the strain-giving condition shown in Table V using the strain-giving means as shown in FIG. 1 as in Test example 1, without performing annealing. The obtained sheets were subjected to the measurement of various properties as with Test example 1. The results are shown in Tables VI and VII.

TABLE V

| Sample No. | Composition: Added element (mass %) | Performing or not performing of annealing after rolling | Strain-giving condition: Number of times | Roll temperature (° C.) | Rolled-sheet temperature (° C.) |
|---|---|---|---|---|---|
| 12 | Al: 9%<br>Zn: 1%<br>Y: 7% | Not performing | 1 | 250 | 200 |
| 13 | Zn: 6%<br>Zr: 0.4% | Not performing | 1 | 250 | 200 |
| 14 | Al: 9%<br>Si: 2% | Not performing | 1 | 250 | 200 |
| 15 | Al: 9%<br>Zn: 1%<br>Ca: 3% | Not performing | 1 | 250 | 200 |
| 16 | Al: 9%<br>Zn: 1%<br>Be: 0.00001% | Not performing | 1 | 250 | 200 |
| 17 | Al: 9%<br>Zn: 1%<br>Mn: 0.2%<br>Si: 0.01%<br>Cu: 0.002%<br>Ni: 0.002% | Not performing | 1 | 250 | 200 |
| 18 | Zn: 1%<br>Eu: 0.2% | Not performing | 1 | 250 | 200 |

TABLE VI

| Sample No. | Crystal grain size (μm) | Indicator value of c-axis orientation | Average c-axis inclining angle (degree) | Area proportion of low-CI region (%) | Half peak width in (0004) diffraction peak in monochromatic X-ray diffraction (deg) | Residual stress (MPa): Rolling direction | Residual stress (MPa): 90-degree direction toward rolling direction | Vickers hardness (Hv) |
|---|---|---|---|---|---|---|---|---|
| 12 | ND | 4.68 | 5 degrees or less | 80 | 0.35 | −25 | −33 | 94 |
| 13 | ND | 4.65 | 5 degrees or less | 81 | 0.34 | −23 | −31 | 92 |
| 14 | ND | 4.71 | 5 degrees or less | 79 | 0.37 | −27 | −34 | 95 |
| 15 | ND | 4.69 | 5 degrees or less | 80 | 0.34 | −22 | −30 | 93 |
| 16 | ND | 4.66 | 5 degrees or less | 80 | 0.36 | −23 | −32 | 94 |
| 17 | ND | 4.71 | 5 degrees or less | 77 | 0.35 | −22 | −31 | 93 |
| 18 | ND | 4.73 | 5 degrees or less | 79 | 0.35 | −23 | −32 | 94 |

TABLE VII

| Sample No. | Direction of tensile test | Tensile test (20° C.): Elongation (%) | Tensile test (20° C.): Tensile strength (MPa) | Tensile test (20° C.): 0.2% proof stress (MPa) | Tensile test: Elongation (%): 200° C. | Tensile test: Elongation (%): 250° C. | Tensile test: Elongation (%): 275° C. |
|---|---|---|---|---|---|---|---|
| 12 | 0 degrees | 9 | 365 | 299 | 138 | 256 | 356 |
| | 90 degrees | 9.7 | 359 | 296 | 116 | 268 | 348 |
| | 45 degrees | 9.4 | 370 | 295 | 112 | 243 | 309 |
| | 135 degrees | 9.5 | 372 | 294 | 114 | 247 | 310 |
| 13 | 0 degrees | 9.1 | 359 | 287 | 141 | 246 | 340 |
| | 90 degrees | 9.8 | 362 | 287 | 121 | 256 | 338 |
| | 45 degrees | 9.3 | 361 | 281 | 115 | 238 | 315 |
| | 135 degrees | 9.3 | 358 | 286 | 110 | 241 | 319 |
| 14 | 0 degrees | 9.1 | 369 | 301 | 120 | 248 | 361 |
| | 90 degrees | 9.6 | 371 | 303 | 114 | 251 | 358 |
| | 45 degrees | 9.4 | 368 | 308 | 109 | 236 | 315 |
| | 135 degrees | 9.3 | 369 | 307 | 103 | 229 | 307 |
| 15 | 0 degrees | 9.1 | 359 | 288 | 142 | 263 | 361 |
| | 90 degrees | 9.3 | 353 | 284 | 125 | 242 | 345 |
| | 45 degrees | 9.4 | 351 | 283 | 106 | 226 | 321 |
| | 135 degrees | 9.3 | 356 | 279 | 103 | 221 | 329 |
| 16 | 0 degrees | 8.9 | 359 | 282 | 152 | 269 | 356 |
| | 90 degrees | 8.8 | 356 | 276 | 126 | 257 | 359 |

TABLE VII-continued

| Sample No. | Direction of tensile test | Tensile test (20° C.) Elongation (%) | Tensile strength (MPa) | 0.2% proof stress (MPa) | Tensile test: Elongation (%) 200° C. | 250° C. | 275° C. |
|---|---|---|---|---|---|---|---|
| | 45 degrees | 8.3 | 351 | 278 | 121 | 253 | 361 |
| | 135 degrees | 8.4 | 353 | 280 | 118 | 254 | 331 |
| 17 | 0 degrees | 8.9 | 362 | 290 | 151 | 246 | 368 |
| | 90 degrees | 9.2 | 361 | 286 | 126 | 253 | 357 |
| | 45 degrees | 9.1 | 359 | 291 | 121 | 234 | 331 |
| | 135 degrees | 9.3 | 362 | 286 | 116 | 238 | 325 |
| 18 | 0 degrees | 8.8 | 364 | 299 | 150 | 254 | 357 |
| | 90 degrees | 9.2 | 359 | 301 | 134 | 263 | 370 |
| | 45 degrees | 9.1 | 361 | 300 | 126 | 229 | 325 |
| | 135 degrees | 8.8 | 363 | 301 | 130 | 227 | 330 |

As shown in Table VI, in Sample Nos. 12 to 18 to which a strain was given such that the half peak width in the (0004) diffraction peak in monochromatic X-ray diffraction fell in the range of 0.20 to 0.59 deg, the low-CI region has an area proportion of 50% or more and less than 90%. In addition, Sample Nos. 12 to 18 all have a compressive residual stress, a relatively high Vickers hardness, an indicator value of c-axis orientation of 4.00 or more, and an average c-axis inclining angle of five degrees or less. Furthermore, Sample Nos. 12 to 18 all have high elongation under a warm condition and excellent mechanical properties at 20° C. Consequently, it can be expected that these magnesium alloy sheets have excellent warm plastic formability and therefore can be suitably used as structural materials.

The above-described embodiments may be changed as required without deviating from the gist of the present invention and consequently are not limited to the above-described constitution. The composition may be changed in such a manner that the Al content is varied in Test example 1, for example.

INDUSTRIAL APPLICABILITY

The magnesium alloy formed body of the present invention can be suitably used for the package of an electronic device such as a cellular phone and a notebook personal computer and for a component of a transportation machine. The magnesium alloy sheet of the present invention can be suitably used as the material for the foregoing formed body of the present invention. The method of the present invention for producing a magnesium alloy sheet can be suitably used for the production of the above-described magnesium alloy sheet of the present invention.

The invention claimed is:

1. A magnesium alloy sheet, comprising magnesium-based alloy and having a half peak width of 0.20 deg or more and 0.59 deg or less in a (0004) diffraction peak in monochromatic X-ray diffraction, wherein:

the sheet has a Vickers hardness (Hv) of 85 or more and 105 or less, and the magnesium-based alloy, constituting the sheet, has a low-confidence-index (low-CI) region that has a confidence index (CI) of less than 0.1 in electron back scattering diffraction (EBSD) measurement, and the low-CI region has an area proportion of 50% or more and less than 90%.

2. The magnesium alloy sheet as defined by claim 1, wherein the magnesium alloy sheet has an indicator value of c-axis orientation of 4.00 or more.

3. The magnesium alloy sheet as defined by claim 1, wherein the sheet has an average c-axis inclining angle of 5 degrees or less.

4. The magnesium alloy sheet as defined by claim 1, the sheet having a surface on which a compressive residual stress exists in the direction of the width of the sheet or in a direction at an angle of 90 degrees toward the direction of the width of the sheet.

5. The magnesium alloy sheet as defined by claim 1, the sheet having a surface on which a compressive residual stress of 0 MPa or more and 100 MPa or less exists in the rolling direction when the rolling direction coincides with a direction at an angle of 90 degrees toward the direction of the width of the sheet.

6. The magnesium alloy sheet as defined by claim 1, the sheet having a surface on which a compressive residual stress of 0 MPa or more and 100 MPa or less exists in a direction at an angle of 90 degrees toward the rolling direction when the rolling direction coincides with a direction at an angle of 90 degrees toward the direction of the width of the sheet.

7. The magnesium alloy sheet as defined by claim 1, the sheet having an elongation of 100% or more at a temperature of 200° C. or higher in all of the directions of zero, 45, 90, and 135 degrees when any given direction of the sheet is assumed to be zero degrees.

8. The magnesium alloy sheet as defined by claim 1, the sheet having an elongation of 200% or more at a temperature of 250° C. or higher in all of the directions of zero, 45, 90, and 135 degrees when any given direction of the sheet is assumed to be zero degrees.

9. The magnesium alloy sheet as defined by claim 1, the sheet having an elongation of 300% or more at a temperature of 275° C. or higher in all of the directions of zero, 45, 90, and 135 degrees when any given direction of the sheet is assumed to be zero degrees.

10. The magnesium alloy sheet as defined by claim 1, the sheet having an elongation of 2.0% or more and 14.9% or less at 20° C., a tensile strength of 350 MPa or more and 400 MPa or less at 20° C., and a 0.2% proof stress of 250 MPa or more and 350 MPa or less at 20° C. in all of the directions of zero, 45, 90, and 135 degrees when any given direction of the sheet is assumed to be zero degrees.

11. The magnesium alloy sheet as defined by claim 1, wherein the magnesium-based alloy contains more than 50 mass % magnesium and at least one element selected from the group consisting of aluminum, zinc, manganese, yttrium, zirconium, copper, silver, and silicon with a total content of 0.01 mass % or more and 20 mass % or less.

12. The magnesium alloy sheet as defined by claim 1, wherein the magnesium-based alloy contains more than 50 mass % magnesium and at least one element selected from the group consisting of calcium and beryllium with a total content of 0.00001 mass % or more and 16 mass % or less.

13. The magnesium alloy sheet as defined by claim 1, wherein the magnesium-based alloy contains more than 50 mass % magnesium and at least one element selected from the group consisting of nickel, gold, platinum, strontium, titanium, boron, bismuth, germanium, indium, terbium, neodymium, niobium, lanthanum, and the rare earth element, except neodymium, terbium, and lanthanum, with a total content of 0.001 mass % or more and 5 mass % or less.

14. A magnesium alloy formed body, produced by performing plastic forming at 200° C. or more on the magnesium alloy sheet as defined by claim 1.

15. The magnesium alloy formed body as defined by claim 14, wherein the plastic forming is performed through press forming.

16. The magnesium alloy formed body as defined by claim 14, wherein the magnesium alloy body has an average crystal grain size of 0.5 μm or more and 5 μm or less.

* * * * *